US006884031B2

(12) United States Patent
Gregory

(10) Patent No.: US 6,884,031 B2
(45) Date of Patent: Apr. 26, 2005

(54) PUMP ASSEMBLY

(75) Inventor: Paul Geoffrey Gregory, Cheshire (GB)

(73) Assignee: Weir Pumps Limited (GB)

( * ) Notice: Subject to any disclaimer, the term of this patent is extended or adjusted under 35 U.S.C. 154(b) by 0 days.

(21) Appl. No.: 10/202,309

(22) Filed: Jul. 24, 2002

(65) Prior Publication Data

US 2003/0021681 A1 Jan. 30, 2003

(30) Foreign Application Priority Data

Jul. 24, 2001 (GB) ..... 0117941

(51) Int. Cl.[7] ..... F04D 29/44
(52) U.S. Cl. ..... 415/199.2; 415/214.1
(58) Field of Search ..... 415/199.1, 199.2, 415/214.1

(56) References Cited

U.S. PATENT DOCUMENTS

| | | | | |
|---|---|---|---|---|
| 2,058,017 A | | 10/1936 | Hollander | 103/109 |
| 2,108,786 A | * | 2/1938 | Bigelow et al. | 415/199.1 |
| 3,718,406 A | * | 2/1973 | Onal | 415/199.1 |
| 3,788,764 A | | 1/1974 | Shuey et al. | 415/198 |
| 3,801,217 A | | 4/1974 | Ryall et al. | 415/199 |
| 4,098,558 A | * | 7/1978 | Bush et al. | 415/199.1 |
| 4,190,395 A | | 2/1980 | Ball | 415/61 |
| 4,715,778 A | * | 12/1987 | Katayama et al. | 415/199.1 |
| 4,778,334 A | * | 10/1988 | Medgyesy et al. | 415/199.1 |
| 4,893,986 A | | 1/1990 | Catterfeld et al. | 415/100 |
| 5,340,272 A | | 8/1994 | Fehlau | 415/110 |
| 5,445,494 A | | 8/1995 | Hanson | 415/107 |
| 6,012,898 A | * | 1/2000 | Nakamura et al. | 415/199.2 |

FOREIGN PATENT DOCUMENTS

| | | |
|---|---|---|
| EP | 0667456 A1 | 8/1995 |
| EP | 0766007 A1 | 4/1997 |

OTHER PUBLICATIONS

Weir Pumps Ltd., Ok Range, Centrifugal Multistage Pumps for the Oil and Gas Industry, Publication WPL 93/6.

* cited by examiner

*Primary Examiner*—Edward K. Look
*Assistant Examiner*—Richard A. Edgar
(74) *Attorney, Agent, or Firm*—Gifford, Krass, Groh, Sprinkle, Anderson & Citkowski

(57) ABSTRACT

A pump assembly particularly for use in high pressure operations is disclosed, which pump assembly is a barrel casing cartridge pump assembly which includes a pump cartridge having a plurality of impeller stages, and a barrel body casing which encases a portion of the pump cartridge. The barrel casing includes a centrally located suction branch which directly feeds a first impeller stage which is located centrally of the pump cartridge. Each impeller of the pump cartridge includes an eye for receiving fluid, the arrangement being such that each eye faces towards the suction branch.

83 Claims, 7 Drawing Sheets

PUMP ASSEMBLY

FIELD OF THE INVENTION

The present invention relates to a pump assembly, and in particular, but not exclusively, to a centrifugal multistage pump assembly for injecting water into a subterranean hydrocarbon bearing formation.

BACKGROUND OF THE INVENTION

In oil and gas extraction operations it is common practice to inject water, such as sea water or production water, into the formation to maintain the pressure of the production fluids. However, to implement this process, some formations would require water to be injected under extremely high pressures, up to 9000 psig, to overcome the formation pressure, which cannot be achieved by conventional single pump arrangements.

One common form of pump arrangement typically used in high pressure operations is a barrel casing cartridge pump, which consists of a pump cartridge comprising the pump stages, which cartridge is located within a body casing which provides and retains the required pressure integrity.

It is amongst objects of at least one embodiment of the present invention to provide a pump assembly capable of producing extremely high pressures suitable for injection into high pressure formations.

SUMMARY OF THE INVENTION

According to a first aspect of the present invention there is provided a pump assembly comprising:

a pump cartridge having a non-drive end and a drive end; and a barrel casing encompassing a portion of the pump cartridge between the drive end and the non-drive end, said barrel casing having a suction branch and a delivery branch in fluid communication via the pump cartridge;

wherein said suction branch is located in a central portion of the barrel casing, between first and second ends of the casing, and the pump cartridge comprises a plurality of impellers each having an eye for receiving fluid and being disposed on either side of the suction branch, the arrangement being such that the eye of each impeller faces towards the suction branch.

Conveniently, each impeller of the pump cartridge corresponds to a single pump stage of the pump assembly.

The drive end of the pump cartridge is adapted for connecting to drive means for driving the pump. The non-drive end is located opposite the drive end.

Centrally positioning the suction branch minimises, in use, distortion effects of the barrel casing and ensures that pressure integrity is optimised, particularly in pumps producing relatively high pressure outputs.

Preferably, the barrel casing of the pump assembly defines a substantially circular cross-section bore extending longitudinally through the casing from the first end to the second end thereof, said bore defining an inner surface of the barrel casing. Preferably the diameter of the bore varies along the length of the barrel casing, the diameter at the first end being greater than the diameter at the second end to allow the pump assembly to be more easily assembled and sealed.

Preferably, the first end of the barrel casing defines a closure end for coupling to the pump cartridge.

Preferably, the barrel casing and the pump cartridge of the pump assembly may be assembled by inserting the pump cartridge into the barrel casing, from the closure end of the barrel casing, such that, when fully fitted, the drive end of the cartridge extends beyond the second end of the barrel casing and the non-drive end extends beyond the first or closure end of the barrel casing.

Preferably also, the pump cartridge may be located in the barrel casing such that portions of the outer surface of the pump cartridge are in sealing engagement with portions of the inner surface of the barrel casing. Sealing means between the surfaces may be, for example, elastomeric O-rings.

To ensure that the pump cartridge is located in the correct position within the barrel casing, there may be provided an annular face which extends radially inwardly from the inner surface of the barrel casing, against which a co-operating radially protruding annular face of the pump cartridge sealingly abuts. Preferably the annular face of the barrel casing is adjacent to the second end thereof to improve pump sealing integrity.

Additionally, the pump cartridge may have a radially extending annular face which sealingly abuts a closure end face of the barrel casing. This annular face may also provide means of providing closure to the barrel casing by acting as an end cover, and which thus serves as a non-drive end cover.

Conveniently, the impellers are mounted on a shaft which extends through the pump cartridge between the drive end and the non-drive end and which shaft may be mounted on respective external, oil lubricated, hydrodynamic journal bearings at the cartridge drive end and non-drive end. Preferably, the shaft is sufficiently stiff to ensure minimum deflection under typical loads.

Each pump impeller may be located in the correct position on the shaft by a key and keyway arrangement, and additionally or alternatively may be secured in place by shrink fitting to the shaft. This involves pre-heating and expanding the impellers and then allowing the impellers to cool once mounted on the shaft. This provides extremely robust retention and may obviate the requirement for the provision of any further sealing means between the shaft and the impellers to prevent leakage between stages.

Preferably, the pump cartridge further comprises a suction guide for delivering fluid from the suction branch to the first stage impeller eye. The first impeller stage may comprise a single entry impeller and would thus require a single suction guide. Alternatively the first impeller stage may comprise a double entry impeller which would require two separate suction guides, one for each entry point.

Preferably, the impellers are located in the pump cartridge such that at least one impeller is located between the suction guide and non-drive end of the pump cartridge and at least one impeller is located between the suction guide and the drive end of the cartridge. Most preferably, the first impeller stage is positioned between the suction guide and the non-drive end and the final stage is positioned between the suction guide and the drive end.

Preferably, the at least one impeller located between the suction guide and the non-drive end is a lower pressure impeller stage than the at least one impeller located between the suction guide and the drive end; in the interests of brevity, the impeller stages between the suction branch and the non-drive end will hereinafter be referred to as the lower pressure stages, and the impeller stages between the suction branch and the drive end will be referred to as the higher pressure stages.

As noted above, each impeller is fitted to the shaft such that each impeller eye faces towards the suction branch, and thus towards the suction guide. The impellers on each side of the suction guide may, therefore, be considered to be arranged in a front-to-front profile. This particular arrangement enables the impellers to be readily removed from the shaft by allowing heat to be applied to a rear portion of each impeller in order that the impellers can be expanded and then removed. Arranging the impellers in a back-to-back profile, that is, with impeller eyes facing away from the suction branch, would make it extremely difficult, if not impossible, to access the rear portions of the impellers to apply heat to allow removal of the impellers from the shaft.

Preferably, the lower pressure stages are in fluid communication with the higher pressure stages via a flow guide, which may be an annulus positioned over the lower pressure stage impellers. The flow guide annulus may be defined by an inner surface of the barrel casing and an outer surface of the pump cartridge.

Preferably, there is provided at least one external, oil lubricated, hydrodynamic thrust bearing to obtain axial hydraulic balance of the pump cartridge of the pump assembly.

Preferably, there are provided three internal journal bearings.

Preferably, an internal journal bearing is located towards the closure end of the barrel casing.

Preferably also, an internal journal bearing is located in the region of the suction branch of the barrel casing.

Preferably, an internal journal bearing is located towards the second end portion of the barrel casing.

Positioning the internal journal bearings in this manner results in high roto-dynamic stability of the shaft and impellers when in operation.

Preferably also, there is a negative pressure differential across at least one internal journal bearing between respective intermediate impeller stages and the suction branch. Additionally, there is a negative pressure differential across the third internal journal bearing between the final impeller stage and the suction branch.

Preferably the internal journal bearings are product lubricated, hydrostatic bearings.

Additionally, each internal journal bearing may be associated with a balance chamber through which fluid is returned to the suction branch, with an associated pressure drop, wherein said balance chamber ensures balance integrity.

Conveniently, the suction branch and delivery branch extend radially from the barrel casing, preferably with the branch longitudinal axes substantially perpendicular to the longitudinal axis of the barrel casing. Preferably each branch comprises a flange portion for connecting to fluid feed and delivery piping, a flange neck extending between the flange and the barrel casing outer surface, and a branch bore extending through the flange portion, flange neck and barrel casing and merging with the barrel casing bore.

The barrel casing may be formed as a single unit with integral suction and delivery branches. Alternatively the barrel casing may be formed and the suction and delivery branches subsequently welded or otherwise fixed to the casing.

The barrel casing may alternatively be formed in two sections such that the barrel casing is axially split. In one embodiment the two sections may be bolted together. This would allow a pump cartridge to be installed as an assembly but would, however, require a substantial sealing arrangement to prevent losses in pressure integrity between the two sections.

In one embodiment of the present invention the pump cartridge may be fixed to the barrel casing using a closure assembly comprising, for example, a plurality of circumferentially spaced bolts extending through the non-drive end cover of the pump cartridge and into the closure end face of the barrel casing. The bolts may be studs which are hydraulically tensioned to generate pre-load and prevent any distortion effects arising from pressure and\or temperature. The bolted arrangement also allows face O-ring seals to be fitted to the main pressure containment joint between the non-drive end cover and the barrel casing closure end face. This provides added security against leakage at the sealing faces between the pump cartridge and the inner surface of the casing caused by extrusion effects at extreme pressures. Bolting the pump cartridge to the barrel cover is the preferred arrangement of pressure containment where extreme pressure integrity is required.

The pump cartridge may alternatively be fixed to the casing by a closure assembly comprising a shear ring\retaining ring arrangement such that the axial load is distributed throughout the whole of the barrel closure end perimeter via a 360 degree shear ring. This arrangement eliminates the need for heavy casing studs, additional sealing flanges and hydraulic tensioning systems and contributes to significant reductions in cartridge replacement down time.

The delivery branch of the barrel casing may be located between the suction branch and the non-drive end of the pump cartridge.

Preferably, the delivery branch of the barrel casing is located between the suction branch of the barrel casing and the drive end of the pump cartridge. Consequently, the suction branch may be located between the delivery branch and the non-drive end. In this arrangement, the delivery branch is located in an end portion of the barrel casing opposite the closure end. This provides an improved stress regime, particularly in the barrel casing, as the high pressure delivery branch is isolated from the closure end where the closure assembly bolts or the like encroach into the end face of the barrel casing. The closure assembly therefore inherently requires the introduction of a number of discontinuities or stress raisers in the casing which may cause the casing to distort more easily under large hoop and circumferential stresses produced by extreme pressures when the pump is running. Additionally, the stress raisers may advance the onset of material fatigue when the casing is subjected to cyclic loading from varying pressures. Remotely positioning the delivery branch from the closure end therefore prevents the barrel casing closure end from being subjected to large pressures and thus prevents losses in integrity, or even complete failure of the pressure seals.

According to a second aspect of the present invention there is provided a pump assembly comprising:

a pump cartridge having a drive end and a non-drive end; and a barrel casing encompassing a portion of the pump cartridge between the drive end and the non-drive end, said barrel casing having a suction branch and a delivery branch in fluid communication via the pump cartridge;

wherein the pump cartridge comprises a plurality of impellers each having an eye for receiving fluid and being fitted on a shaft which extends through the pump cartridge between the drive end and the non-drive end, said shaft being associated with at least one internal product lubricated, hydrostatic bearing.

Conveniently, each impeller of the pump cartridge corresponds to a single stage of the pump assembly.

Preferably, the suction branch is located in a central portion of the barrel casing, between first and second ends of the casing.

Conveniently, the shaft may be mounted on respective external, oil lubricated, hydrodynamic journal bearings at the cartridge drive end and non-drive end. Preferably, the shaft is sufficiently stiff to ensure minimum deflection under typical loads.

Each pump impeller may be located in the correct position on the shaft by a key and keyway arrangement, and additionally or alternatively may be secured in place by shrink fitting to the shaft. This involves pre-heating and expanding the impellers and then allowing the impellers to cool once mounted on the shaft. This provides extremely robust retention and may obviate the requirement for the provision of any further sealing means between the shaft and the impellers to prevent leakage between stages.

Preferably, the pump cartridge further comprises a suction guide for delivering fluid from the suction branch to the first stage impeller eye. The first impeller stage may comprise a single entry impeller and would thus require a single suction guide. Alternatively the first impeller stage may comprise a double entry impeller which would require two separate suction guides, one for each entry point.

Preferably, the impellers are located in the pump cartridge such that at least one impeller is located between the suction guide and non-drive end of the pump cartridge and at least one impeller is located between the suction guide and the drive end of the cartridge. Most preferably, the first impeller stage is positioned between the suction guide and the non-drive end and the final stage is positioned between the suction guide and the drive end.

Preferably, the at least one impeller located between the suction guide and the non-drive end is a lower pressure impeller stage than the at least one impeller located between the suction guide and the drive end; in the interests of brevity, the impeller stages between the suction branch and the non-drive end will hereinafter be referred to as the lower pressure stages, and the impeller stages between the suction branch and the drive end will be referred to as the higher pressure stages.

Preferably, the lower pressure stages are in fluid communication with the higher pressure stages via a flow guide, which may be an annulus positioned over the lower pressure stage impellers. The flow guide annulus may be defined by an inner surface of the barrel casing and an outer surface of the pump cartridge.

Preferably, there is provided at least one external, oil lubricated, hydrodynamic thrust bearing to obtain axial hydraulic balance of the pump cartridge of the pump assembly.

Preferably, there are provided three internal, product lubricated, hydrostatic bearings.

Preferably, an internal hydrostatic bearing is located towards the closure end of the barrel casing.

Preferably also, an internal hydrostatic bearing is located in the region of the suction branch of the barrel casing.

Preferably, an internal hydrostatic bearing is located towards the second end portion of the barrel casing.

Positioning the internal journal bearings in this manner results in high roto-dynamic stability of the shaft and impellers when in operation.

Preferably also, there is a negative pressure differential across at least one internal hydrostatic bearing between respective intermediate impeller stages and the suction branch. Additionally, there is a negative pressure differential across an internal journal bearing between the final impeller stage and the suction branch.

Conveniently, each internal journal bearing may be associated with a balance chamber through which fluid is returned to the suction branch, with an associated pressure drop, wherein said balance chamber ensures balance integrity.

According to a third aspect of the present invention there is provided a pump assembly comprising:

a pump cartridge having a drive end and a non-drive end; and a barrel casing encompassing a portion of the pump cartridge between the drive end and the non-drive end, said barrel casing having a suction branch and a delivery branch in fluid communication via the pump cartridge;

wherein said suction branch is located in a central portion of the barrel casing, between first and second ends of the casing.

According to a fourth aspect of the present invention there is provided a pump assembly comprising:

a pump cartridge having a drive end and a non-drive end; and a barrel casing encompassing a portion of the pump cartridge between the drive end and the non-drive end, said barrel casing having a suction branch and a delivery branch in fluid communication via the pump cartridge;

wherein said delivery branch is located in an end portion of the barrel casing, between the suction branch of the barrel casing and the drive end of the pump cartridge.

According to a fifth aspect of the present invention, there is provided a pump assembly comprising:

a pump cartridge having a non-drive end and a drive end; and a barrel casing encompassing a portion of the pump cartridge between the drive end and the non-drive end, said barrel casing having a suction branch and a delivery branch in fluid communication via the pump cartridge;

wherein said suction branch is located in a central portion of the barrel casing, between first and second ends of the casing, and the pump cartridge comprises a plurality of impellers each having an eye for receiving fluid, at least one impeller being located between the suction branch and the non-drive end of the pump cartridge and at least one impeller is located between the suction branch and the drive end of the pump cartridge, the arrangement being such that the eye of each impeller faces towards the suction branch, and the at least one impeller located between the suction branch and the non-drive end is in fluid communication with the at least one impeller located between the suction branch and the drive end via a flow guide annulus defined between the pump cartridge and the barrel casing.

According to a sixth aspect of the present invention, there is provided a pump assembly comprising:

a pump cartridge having a drive end and a non-drive end; and a barrel casing encompassing a portion of the pump cartridge between the drive end and the non-drive end, said barrel casing having a suction branch and a delivery branch in fluid communication via the pump cartridge;

wherein said suction branch is located in a central portion of the barrel casing, between first and second ends of the casing, and said delivery branch is located in an end portion of the barrel casing, between the suction branch of the barrel casing and the drive end of the pump cartridge.

According to a seventh aspect of the present invention, there is provided a pump assembly comprising:

a pump cartridge having a drive end and a non-drive end; and a barrel casing encompassing a portion of the pump cartridge between the drive end and the non-drive end, said barrel casing having a suction branch and a delivery branch in fluid communication via the pump cartridge;

wherein said pump cartridge comprises a plurality of stages, the first of said stages being located centrally of the barrel casing.

Preferably the pump assembly is a centrifugal pump. More preferably, the pump assembly is a centrifugal multi-stage pump.

In one embodiment the pump assembly is a nine-stage centrifugal pump, and the pump assembly impeller stages are split such that five impellers are located between the suction guide and the non-drive end and four impellers are located between the suction guide and the drive end.

More preferably however, the pump assembly impeller stages are split such that three impellers are located between the suction guide and the non-drive end of the pump cartridge and six impellers are located between the suction guide and the drive end. This particular arrangement gives rise to a lower pressure drop between at least two of the three internal journal bearings and the suction branch and thus provides dynamic stability with lower flowrates across the bearings, which results in lower flow losses and a higher pump efficiency.

Preferably, the pump assembly is a high pressure water injection pump for injecting water into a subterranean hydrocarbon formation. Preferably the pump assembly may inject water at a pressure of up to at least 9,000 psig.

BRIEF DESCRIPTION OF THE DRAWINGS

These and other aspects of the present invention will now be described, by way of example only, with reference to the accompanying drawings, in which.

DETAILED DESCRIPTION OF THE PREFERRED EMBODIMENTS

Figure 1:
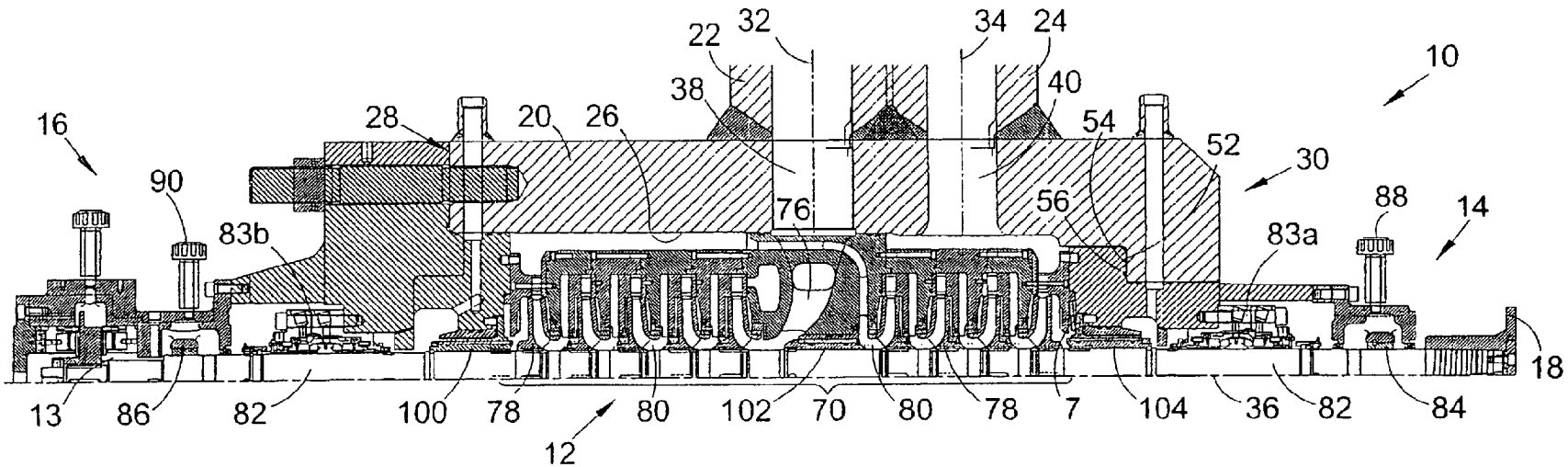
FIG. 1 is a sectional view of a pump assembly in accordance with one embodiment of the present invention.

Reference is first made to FIGS. 1 and 2*a* to 2*d* of the drawings in which there is shown a pump assembly generally indicated by reference numeral 10, in accordance with one embodiment of the present invention. The pump assembly 10 is a centrifugal multistage pump comprising a pump cartridge 12 having a drive end 14 and a non-drive end 16, wherein the drive end 14 comprises a coupling hub 18 for attaching to drive means (not shown), typically an electric motor, possibly via a speed increasing gearbox or a gas turbine. Encompassing a portion of the pump cartridge 12 between the drive end 14 and non-drive end 16 is a barrel casing 20 having a suction branch 22 and delivery branch 24 which are in fluid communication via the pump cartridge 12.

The barrel casing 20 defines a bore 26 extending longitudinally through the casing from a first, closure end 28, to a second end 30 thereof. As can be seen from FIG. 1, the diameter of the bore 26 varies along the length of the barrel casing 20 with the closure end 28 diameter being larger than the second end 30 diameter.

The suction and delivery branches 22, 24 extend radially from the barrel casing 20 with the branch axes 32, 34 being substantially perpendicular to the barrel casing longitudinal axis 36. Each branch comprises a bore 38, 40 which merges with the barrel casing bore 26.

In this embodiment the suction branch 22 is located in a central portion of the barrel casing 20 and the delivery branch 24 is located between the suction branch 22 and the barrel casing second end 30. This arrangement minimises distortion effects of the barrel casing 20, and improves the sealing integrity of the pump assembly 10.

The pump assembly 10 is assembled by inserting the pump cartridge 12 into the barrel casing bore 26 from the casing closure end 28 such that, when fully fitted, the drive end 14 extends beyond the casing second end 30 and the non-drive end 16 extends beyond the casing closure end 28.

Figure 2A:
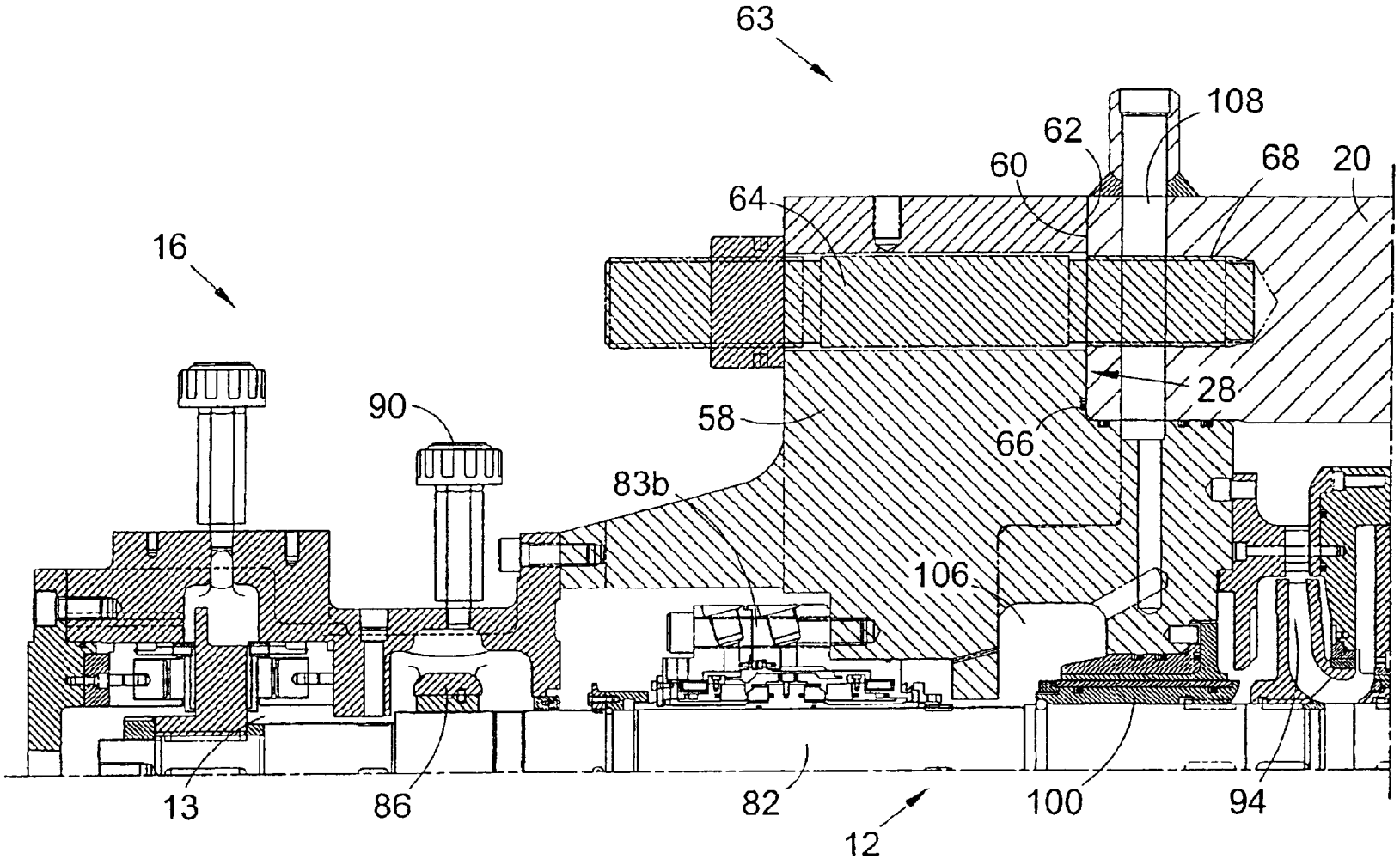
FIGS. 2*a* to 2*d* are enlarged views of the pump assembly of FIG. 1.
Figure 2B:
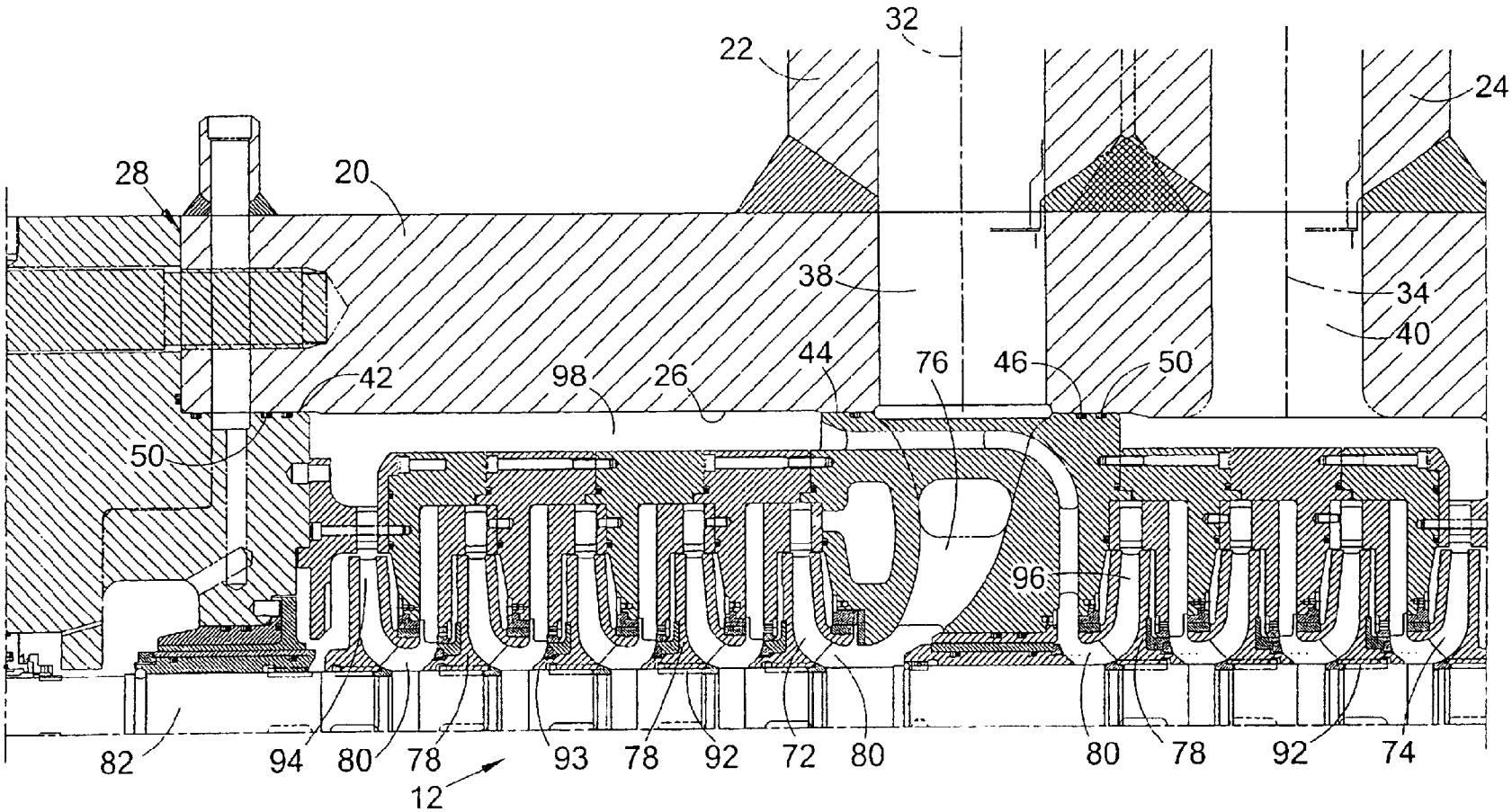
Figure 2C:
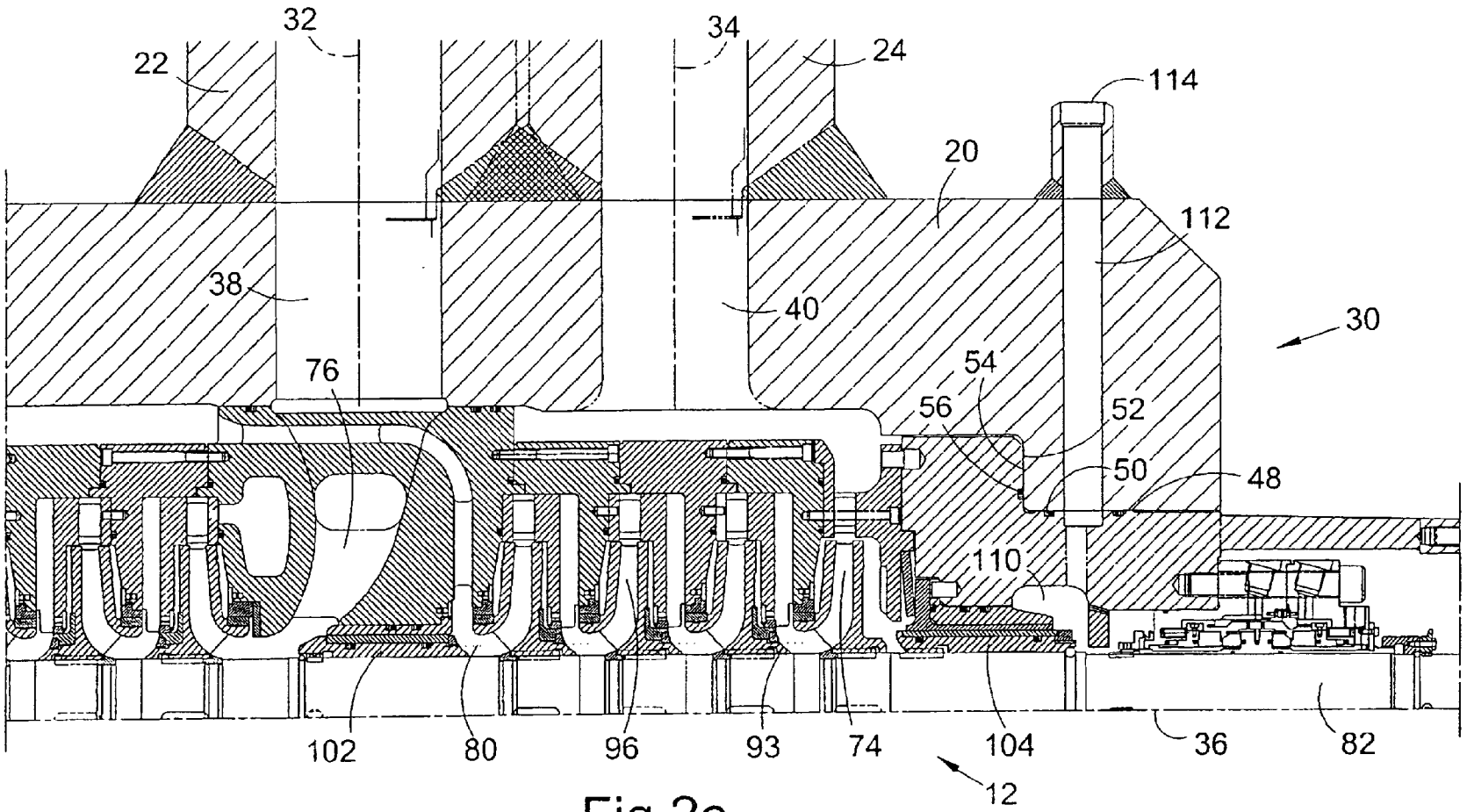

When fully assembled, portions of the outer surface of the pump cartridge 12 are in sealing engagement with portions of the inner surface of the barrel casing, as shown in FIGS. 2*b* and 2*c*, at the locations indicated by reference numerals 42, 44, 46 and 48. O-ring seals 50 are provided between the surfaces to seal the pump assembly against leakage.

The pump cartridge 12 is correctly positioned within the casing 20 by sealing engagement of an inwardly extending annular face 52 of the casing 20 and a radially extending annular face 54 of the pump cartridge 12, which is shown more clearly in FIG. 2*c*. An elastomeric O-ring seal 56 is provided between the annular faces 52, 54. Additionally, the pump cartridge 12 has an non-drive end cover 58, as shown in FIG. 2*a*, where the cover 58 has an end face 60 which abuts the closure end face 62 of the barrel casing 20, and also provides closure to the casing 20.

Referring to FIG. 2*a*, there is shown an enlarged view of the non-drive end 16 of the pump cartridge 12 where the pump cartridge 12 is secured to the barrel casing 20 by a closure assembly 63. A plurality of circumferentially spaced bolts 64 (only one shown) extend through the non-drive end cover 58 and into the casing closure end face 62. The bolts are studs which are hydraulically tensioned to generate pre-load which helps to prevent any distortion effects arising from pressure and\or temperature when the pump assembly 10 is in operation. This bolted arrangement allows for face O-ring seals 66 to be fitted to the main pressure containment joint between the non-drive end cover 58 and the barrel casing closure end face 62. This provides added security against leakage between the faces 60, 62.

It should be noted that remotely positioning the delivery branch 24 from the closure end 28 of the barrel casing provides an improved stress regime as high pressure fluid exiting the pump assembly 10 through the delivery branch 24 is isolated from the closure end 28 where the closure assembly bolts 64 encroach into the end face of the barrel casing 62. This requires a number of stud holes 68 in the barrel casing 20 to accommodate the bolts 64.

Referring again to FIGS. 1 and 2*a* to 2*d*, the pump cartridge 12 will now be described in more detail. The pump cartridge comprises a number of impeller stages 70, the first impeller stage 72, shown more clearly in FIG. 2*b*, being aligned with the suction branch 22 of the barrel casing 20, and the final impeller stage 74 being aligned with the delivery branch 24.

The pump cartridge 12 further comprises a suction guide 76 which delivers fluid from the suction branch 22 to the first impeller stage 72.

In this embodiment of the present invention nine impeller stages are provided, the first five of which positioned between the suction guide 76 and the non-drive end 16, with the remaining four, final stages, being positioned between the suction guide 76 and the drive end 14.

With reference still to FIG. 2*b* it can be seen that each impeller stage 70 comprises a pump impeller 78, each impeller having an impeller eye 80 for receiving fluid.

Referring additionally to FIG. 1, the impellers 78 are mounted on a shaft 82 which extends through the pump cartridge between the drive end 14 and non-drive end 16. The shaft 82 is mounted on two hydrodynamic journal bearings 84, 86 (FIG. 1) located at the drive end 14 and non-drive end 16 respectively, each journal bearing 84, 86 having a lubrication port 88, 90 for force feeding the bearings 84, 86 with lubrication oil. A hydrodynamic thrust bearing 13 is also provided which provides hydraulic balance to the pump rotating assembly. The shaft 82 is provided with mechanical shaft sealing means 83*a*, 83*b* towards each end of the shaft for preventing fluid leakage from the pump cartridge 12.

Each pump impeller 78 is located on the shaft 82 by a key and a keyway arrangement 92, as shown in FIG. 2*b*, and is secured in place by shrink fitting to the shaft 82 rearwardly of the respective keyway, as indicated by reference numeral 93. This provides extremely robust retention and obviates the requirement for the provision of separate sealing members between the shaft 82 and the impellers 78.

As can be seen from FIG. 1, and more clearly in FIG. 2*b*, the impellers 78 are arranged in a front-to-front configuration such that each impeller eye 80 faces towards the suction guide 76. This configuration has a particular advantage when seeking to remove the impellers 78 from the shaft 82 as heat can be easily applied to the backs of each impeller 78 such that they can be expanded and removed.

With reference to FIG. 2*b* only, the fifth impeller stage 94 is in fluid communication with the sixth impeller stage 96, on the opposite side of the suction guide 76, via a flow guide annulus 98 positioned over the first to fifth impeller stages; that is, those impeller stages positioned to the left of the suction guide 78 in the drawings.

Reference is now made to FIGS. 2*a* and 2*c* in which there is shown three hydrostatic internal journal bearings 100, 102, 104, however the general position of each internal journal bearing 100, 102, 104 with respect to the pump assembly 10 can be more readily appreciated from FIG. 1.

The first internal journal bearing 100 (FIG. 2*a*) is located towards the closure end 28 of the barrel casing and provides a five stage pressure drop across the bearing. Fluid from the fifth stage impeller 94 is forced through the internal journal bearing 100 into a balance chamber 106, from where the fluid subsequently flows through a bore 108 which extends through the pump cartridge 12 and the barrel casing 20. Once the fluid exits the bore 108 it is flowed back to the suction branch via appropriate fluid piping (not shown).

The second internal journal bearing 102 (FIG. 2*c*) is located in the region of the suction branch 22 of the barrel casing 20 and also provides a five stage pressure drop across the bearing. In this case, fluid from the impeller eye 80 of the sixth impeller stage 96 is forced through the internal journal bearing 102 and directly into the suction guide 76 of the pump cartridge 12.

The third internal journal bearing 104 (FIG. 2*c*) is located towards the second end 30 of the barrel casing 20 and provides a pressure drop of all nine stages across the bearing. In a similar fashion as the first internal journal bearing 100, fluid from the ninth, final stage impeller 74 is forced through the third internal journal bearing 104, into a balance chamber 110 and through a bore 112. The fluid is then flowed from the bore exit 114 to the suction branch 22 via fluid piping (not shown).

Figure 3:
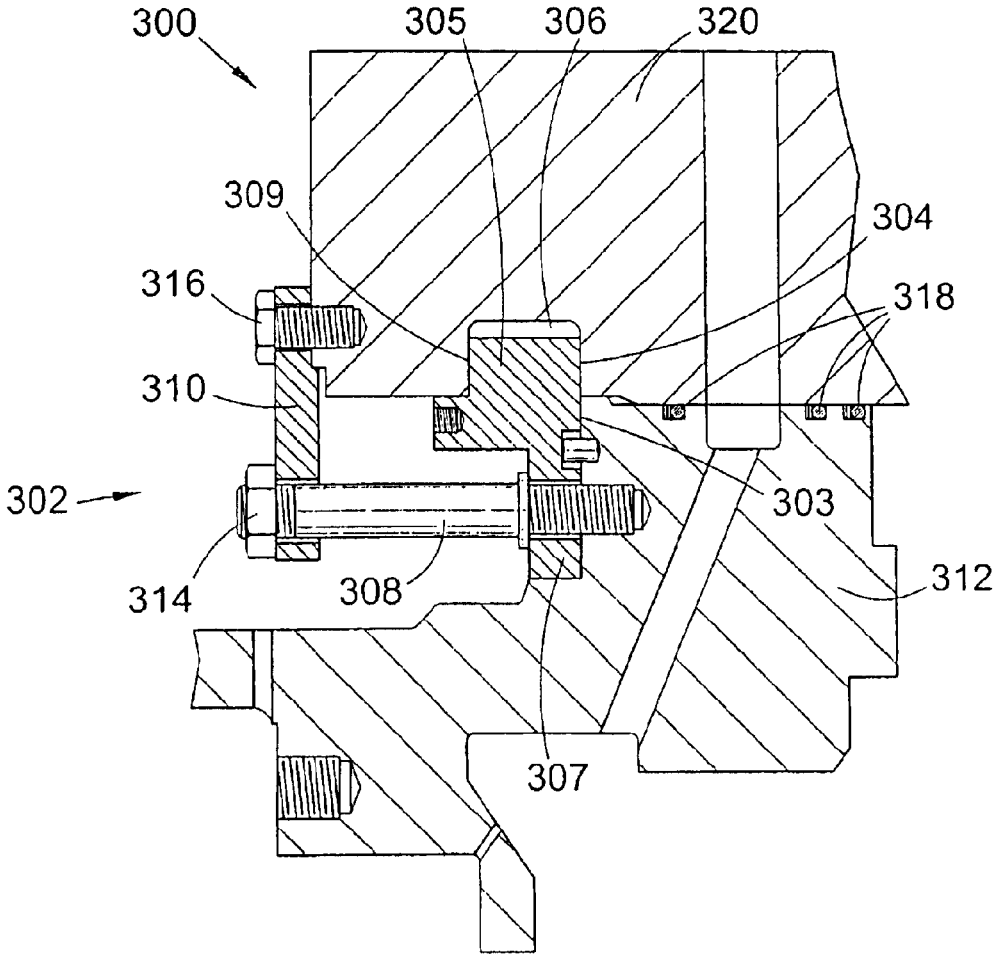
FIG. 3 is a sectional view of a closure assembly of a pump assembly in accordance with an alternative embodiment of the present invention.

Referring now to FIG. 3, there is shown an alternative closure arrangement in accordance with another embodiment of the present invention. This arrangement distributes the axial internal pressure load throughout the whole of the end cover 300 perimeter via a 360 shear ring closure arrangement 302 to the end of the barrel casing 320.

Figure 2D:
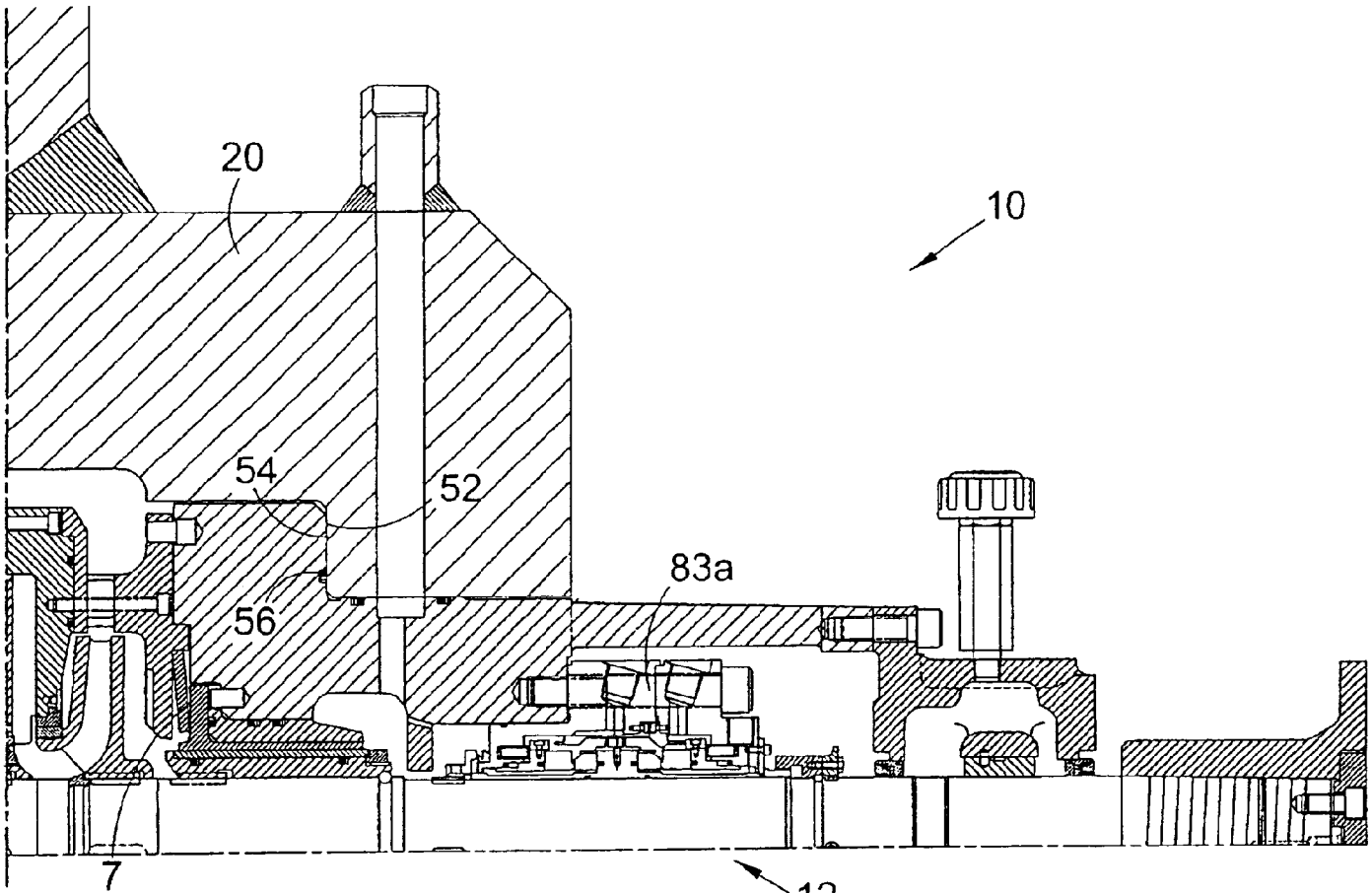

As before, the pump cartridge 312 is inserted into the pump barrel casing 320 and once the pump cartridge 312 is fully inserted, an axial load is applied to the pump coupling hub 18 (FIG. 1) to pull the pump shaft against the thrust bearing 13 (FIG. 1) thus compressing disc spring 7 (shown in FIG. 1 and more clearly in FIG. 2*d*). This action displaces a face 303 on the end cover 300 towards the opposite end (not shown) of the barrel casing 320 such that the face 303 is misaligned from face 304 on the barrel casing 320. A shear ring 305, which is in four sections, is then inserted into a groove 306 in the barrel casing 320. A ring 307 is then inserted such that its outer diameter engages the shear ring 305 and its inner diameter engages the pump cartridge 312. Studs 308 are then fitted to positively clamp the ring 307 to the pump cartridge 312. The tension applied to the pump shaft to permit installation of shear ring 305 is then removed and disc spring 7 urges the pump cartridge 312 such that the pump cartridge is loaded against shear ring 305 which in turn is loaded against face 309 of the barrel casing 320. A ring 310 is then fitted over studs 308 and nuts 314 (only one shown) are then fitted and tightened to ensure positive loading of the pump cartridge 312 onto the shear ring 305 and of the shear ring 305 onto the barrel casing 320. Finally, set pins 316 are fitted to secure the ring 310 to the casing 320.

In operation, when pressure load is generated when the pump is running, the load is transmitted through the pump cartridge 312 to the shear ring 305 and through the shear ring 305 to the barrel casing 320. Because the faces 303 and 309 are at different diameters, the load applied to the shear ring 305 tends to cause the ring 305 to rotate. This rotational movement is limited by the ring 307 which engages the pump cartridge 312 and the shear ring 305. Sealing against leakage between the pump cartridge 312 and the barrel casing 320 is effected by means of elastomeric O-ring seals 318.

Figure 4:
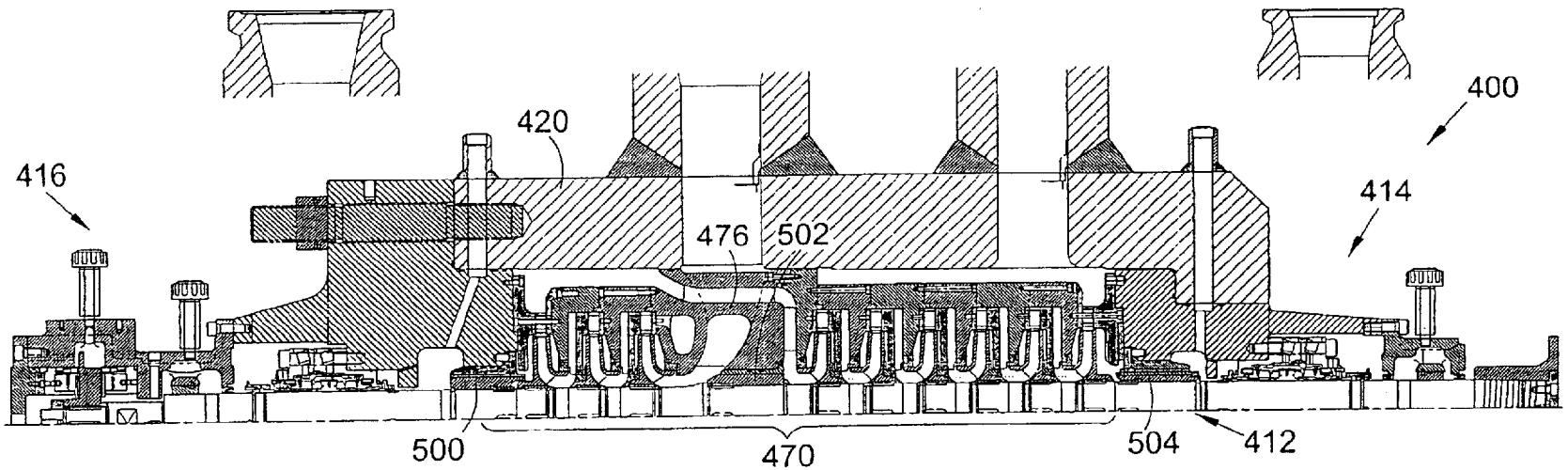
FIG. 4 is a sectional view of a pump assembly in accordance with another embodiment of the present invention.

Reference is now made to FIG. 4 in which there is shown a pump assembly 400 in accordance with a second embodiment of the present invention. Like components share the same reference numerals as those of FIGS. 1 and 2*a* to 2*d*, except incremented by 400.

This embodiment of the present invention is similar to that shown in FIG. 1 with the primary exception that the pump assembly impeller stages 470 are split such that three stages are positioned between the suction guide 476 and the non-drive end 416 of the pump cartridge 412, and the remaining six stages are positioned between the suction guide 476 and the drive end 414 of the pump cartridge 412.

In this regard, therefore, first and second journal bearings 500, 502 each provide a pressure drop of three stages and a third journal thrust bearing 504 provides a pressure drop of nine stages. When the pump is used in applications where extremely large pressures are involved, it would be preferred to use the embodiment of the invention having the impeller stages split 3\6 on either side of the suction guide 476 since there would be a smaller pressure drop experienced across two of the journal bearings 500, 502. This is particularly advantageous as bearing flow losses are minimised thus increasing the efficiency of the pump.

Various modifications may be made to the embodiments hereinbefore described without departing from the scope of the invention. For example, any suitable number of impeller stages may be used, and the impeller stages may be positioned in the pump cartridge such that they are split between the suction guide in a manner which is suitable to the particular application. The suction and the delivery branches may be located in any suitable position in the barrel casing, for example, the delivery branch may be located in the closure end of the barrel casing. Any number of internal product lubricated hydrostatic journal bearings may be used and may be located in alternative positions depending upon the hydraulic balance required.

What is claimed is:

1. A pump assembly comprising:

a pump cartridge having a non-drive end and a drive end; and a barrel casing encompassing a portion of the pump cartridge between the drive end and non-drive end, said barrel casing having a suction branch and a delivery branch in fluid communication via the pump cartridge;

wherein the suction branch extends radially from the barrel casing and is located in a central portion of the barrel casing between first and second ends of the casing.

2. A pump assembly comprising:

a pump cartridge having a non-drive end and a drive end; and a barrel casing encompassing a portion of the pump cartridge between the drive end and the non-drive end, said barrel casing having a suction branch and a delivery branch in fluid communication via the pump cartridge;

wherein said pump cartridge comprises a plurality of pump stages, the first of said pump stages being located centrally of the barrel casing and subsequent pump stages being located on either side of the first pump stage, and wherein said suction branch is located in a central portion of the barrel casing and communicates fluid to the first pump stage when in use.

3. A pump assembly comprising:

a pump cartridge having a non-drive end and a drive end; and a barrel casing encompassing a portion of the pump cartridge between the drive end and the non-drive end, said barrel casing having a suction branch and a delivery branch in fluid communication via the pump cartridge;

wherein said suction branch is located in a central portion of the barrel casing, between first and second ends of the casing, and the pump cartridge comprises a plurality of impellers each having an eye for receiving fluid, at least one impeller being located between the suction branch and the non-drive end of the pump cartridge and at least one impeller is located between the suction branch and the drive end of the pump cartridge, the arrangement being such that the eye of each impeller faces towards the suction branch, and the at least one impeller located between the suction branch and the non-drive end is in fluid communication with the at least one impeller located between the suction branch and the drive end via a flow guide annulus defined between the pump cartridge and the barrel casing.

4. A pump assembly comprising:

a pump cartridge having a drive end and a non-drive end; and a barrel casing encompassing a portion of the pump cartridge between the drive end and the non-drive end, said barrel casing having a suction branch and a delivery branch in fluid communication via the pump cartridge;

wherein said suction branch is located in a central portion of the barrel casing, between first and second ends of the casing, and said delivery branch is located in an end portion of the barrel casing, between the suction branch of the barrel casing and the drive end of the pump cartridge.

5. A pump assembly comprising:

a pump cartridge having a drive end and a non-drive end; and a barrel casing encompassing a portion of the pump cartridge between the drive end and the non-drive end, said barrel casing having a suction branch and a delivery branch in fluid communication via the pump cartridge;

wherein said pump cartridge comprises a plurality of stages, the first of said stages being located centrally of the barrel casing.

6. A pump assembly comprising:

a pump cartridge having a non-drive end and a drive end; and a barrel casing encompassing a portion of the pump cartridge between the drive end and the non-drive end, said barrel casing having a suction branch and a delivery branch in fluid communication via the pump cartridge, the suction branch being located in a central portion of the barrel casing, between first and second ends of the casing;

wherein the pump cartridge comprises a plurality of impellers each having an eye for receiving fluid and being fitted on a shaft which extends through the pump cartridge between the drive end and the non-drive end, said shaft being associated with at least one internal product lubricated, hydrostatic bearing.

7. A pump assembly according to claim 6, wherein the shaft is mounted on respective external, oil lubricated, hydrodynamic journal bearings at the cartridge drive end and drive end.

8. A pump cartridge according to claim 6, wherein each impeller is located on the shaft by a key and keyway arrangement.

9. A pump assembly according to claim 6, wherein the impellers are secured in place by shrink fitting to the shaft.

10. A pump assembly according to claim 6, wherein there is provided at least one external, oil lubricated, hydrodynamic thrust bearing located in the region of the non-drive end.

11. A pump assembly according to claim 6, wherein there are provided three internal, product lubricated, hydrostatic bearings.

12. A pump assembly according to claim 6, wherein an internal hydrostatic bearing is located towards the first end of the barrel casing.

13. A pump assembly according to claim 6, wherein an internal hydrostatic bearing is located in the region of the suction branch of the barrel casing.

14. A pump assembly according to claim 6, wherein an internal hydrostatic bearing is located towards the second end of the barrel casing.

15. A pump assembly according to claim 6, wherein there is a negative pressure differential across at least one internal hydrostatic bearing between respective intermediate impeller stages and the suction branch.

16. A pump assembly according to claim 6, wherein there is a negative pressure differential across an internal hydrostatic bearing between the final impeller stage and the suction branch.

17. A pump assembly according to claim 6, wherein at least one internal hydrostatic bearing is associated with a balance chamber through which fluid is returned to the suction branch with an associated pressure drop.

18. A pump assembly according to claim 6, wherein each impeller corresponds to a single stage of the pump assembly.

19. A pump assembly according to claim 18, wherein the pump cartridge further comprises a suction guide for delivering fluid from the suction branch to a first stage impeller eye.

20. A pump assembly according to claim 19, wherein a first impeller stage is positioned between the suction guide and the non-drive end.

21. A pump assembly according to claim 19, wherein a final stage impeller is positioned between the suction guide and the drive end.

22. A pump assembly according to claim 19, wherein the impellers are located in the pump cartridge such that at least one impeller is located between the suction guide and non-drive end of the pump cartridge and at least one impeller is located between the suction guide and the drive end of the cartridge.

23. A pump assembly according to claim 22, wherein the at least one impeller located between the suction guide and the non-drive end is a lower pressure impeller stage than the at least one impeller located between the suction guide and the drive end.

24. A pump assembly according to claim 22, wherein the at least one impeller located between the suction guide and the non-drive end is in fluid communication with the at least one impeller located between the suction guide and the drive end via a flow guide.

25. A pump assembly according to claim 24, wherein the flow guide is an annulus positioned over the at least one impeller located between the suction guide and the non-drive end.

26. A pump assembly according to claim 25, wherein the flow guide annulus is defined by an inner surface of the barrel casing and an outer surface of the pump cartridge.

27. A pump assembly comprising:

a pump cartridge having a non-drive end and a drive end; and a barrel casing encompassing a portion of the pump cartridge between the drive end and the non-drive end, said barrel casing having a suction branch and a delivery branch in fluid communication via the pump cartridge;

wherein said suction branch is located in a central portion of the barrel casing, between first and second ends of the casing, and the pump cartridge comprises a plurality of impellers each having an eye for receiving fluid and being disposed on either side of the suction branch, the arrangement being such that the eye of each impeller faces towards the suction branch.

28. A pump assembly according to claim 27, wherein the suction branch extends radially from the barrel casing.

29. A pump assembly according to claim 27, wherein the delivery branch extends radially from the barrel casing.

30. A pump assembly according to claim 27, wherein the suction branch longitudinal axis is substantially perpendicular to the longitudinal axis of the barrel casing.

31. A pump assembly according to claim 27, wherein the delivery branch longitudinal axis is substantially perpendicular to the longitudinal axis of the barrel casing.

32. A pump assembly according to claim 27, wherein each branch comprises a flange portion for connecting to fluid feed and delivery piping, a flange neck extending between the flange and the barrel casing outer surface, and a branch bore extending through the flange portion, flange neck and barrel casing and merging with the barrel casing bore.

33. A pump assembly according to claim 27, wherein the delivery branch of the barrel casing is located between the suction branch of the barrel casing and the drive end of the pump cartridge.

34. A pump assembly according to claim 27, wherein the delivery branch is located between the suction branch and the non-drive end of the pump cartridge.

35. A pump assembly according to claim 27, wherein the barrel casing is formed as a single unit with integral suction and delivery branches.

36. A pump assembly according to claim 27, wherein the barrel casing is formed and the suction and delivery branches are subsequently fixed to the casing.

37. A pump assembly according to claim 27, wherein the pump cartridge is fixed to the casing by a closure assembly comprising a shear ring arrangement.

38. A pump assembly according to claim 27, wherein the pump assembly is a centrifugal pump.

39. A pump assembly according to claim 27, wherein the pump assembly is a centrifugal multistage pump.

40. A pump assembly according to claim 27, wherein the pump assembly is a nine-stage centrifugal pump.

41. A pump assembly according to claim 27, wherein the pump assembly impellers are split such that five impellers are located between the suction branch and the non-drive end and four impellers are located between the suction branch and the drive end.

42. A pump assembly according to claim 27, wherein the pump assembly impellers are split such that three impellers are located between the suction branch and the non-drive end of the pump cartridge and six impellers are located between the suction branch and the drive end.

43. A pump assembly according to claim 27, wherein the pump assembly is a high pressure water injection pump for injecting water into a subterranean hydrocarbon formation.

44. A pump assembly according to claim 27, wherein the pump assembly produces pressures of up to at least 9,000 psig.

45. A pump assembly according to claim 27, wherein the barrel casing is formed in two sections such that the barrel casing is axially split.

46. A pump assembly according to claim 45, wherein the two sections of the barrel casing are bolted together.

47. A pump assembly according to claim 27, wherein the pump cartridge is fixed to the barrel casing using a closure assembly comprising a plurality of circumferentially spaced bolts extending through a non-drive end cover of the pump cartridge and into a closure end face of the barrel casing.

48. A pump assembly according to claim 47, wherein the bolts are hydraulically tensioned studs.

49. A pump assembly according to claim 47, wherein face O-ring seals are provided between the non-drive end cover and the barrel casing closure end face.

50. A pump assembly according to claim 27, wherein each impeller corresponds to a single pump stage of the pump assembly.

51. A pump assembly according to claim 27, wherein the drive end of the pump cartridge is adapted for connecting to drive means for driving the pump.

52. A pump assembly according to claim 27, wherein the first end of the barrel casing defines a closure end for coupling to the pump cartridge.

53. A pump assembly according to claim 27, wherein the barrel casing and the pump cartridge are assembled by inserting the pump cartridge into the barrel casing, from the closure end of the barrel casing, such that, when fully fitted, the drive end of the cartridge extends beyond the second end of the barrel casing and the non-drive end extends beyond the first end of the barrel casing.

54. A pump assembly according to claim 27, wherein the pump cartridge is located in the barrel casing such that portions of the outer surface of the pump cartridge are in sealing engagement with portions of the inner surface of the barrel casing.

55. A pump assembly according to claim 27, wherein elastomeric O-ring seals are provided between the barrel casing and the pump cartridge.

56. A pump assembly according to claim 27, wherein there is provided at least one external, oil lubricated, hydrodynamic thrust bearing located in the region of the non-drive end.

57. A pump assembly according to claim 27, wherein the barrel casing has an annular face which extends radially inwardly from the inner surface of the barrel casing, against which annular face a co-operating radially protruding annular face of the pump cartridge sealingly abuts.

58. A pump assembly according claim 57, wherein the annular face of the barrel casing is adjacent to the second end thereof.

59. A pump assembly according to claim 27, wherein the pump cartridge has a radially extending annular face which sealingly abuts a closure end face of the barrel casing.

60. A pump assembly according to claim 59, wherein the annular face serves as a non-drive end cover and provides closure to the barrel casing.

61. A pump assembly according to claim 27, wherein the barrel casing defines a substantially circular cross-section bore extending longitudinally through the casing from the first end to the second end thereof, said bore defining an inner surface of the barrel casing.

62. A pump assembly according to claim 61, wherein the diameter of the bore varies along the length of the barrel casing.

63. A pump assembly according to claim 61, wherein the diameter at the first end of the barrel casing is greater than the diameter at the second end of the barrel casing.

64. A pump assembly according to claim 27, wherein the impellers are mounted on a shaft which extends through the pump cartridge between the drive end and the non-drive end.

65. A pump assembly according to claim 64, wherein the shaft is mounted on respective external, oil lubricated, hydrodynamic journal bearings at the cartridge drive end and non-drive end.

66. A pump cartridge according to claim 64, wherein each pump impeller is located on the shaft by a key and keyway arrangement.

67. A pump assembly according to claim 64, wherein the impellers are secured in place by shrink fitting to the shaft.

68. A pump assembly according to claim 27, wherein the pump cartridge further comprises a suction guide for delivering fluid from the suction branch to a first stage impeller eye.

69. A pump assembly according to claim 68, wherein a first impeller stage is positioned between the suction guide and the non-drive end.

70. A pump assembly according to claim 68, wherein a final stage impeller is positioned between the suction guide and the drive end.

71. A pump assembly according to claim 68, wherein the impellers are located in the pump cartridge such that at least one impeller is located between the suction guide and non-drive end of the pump cartridge and at least one impeller is located between the suction guide and the drive end of the cartridge.

72. A pump assembly according to claim 71, wherein the at least one impeller located between the suction guide and the drive end is a lower pressure impeller stage than the at least one impeller located between the suction guide and the drive end.

73. A pump assembly according to claim 71, wherein the at least one impeller located between the suction guide and the non-drive end is in fluid communication with the at least one impeller located between the suction guide and the drive end via a flow guide.

74. A pump assembly according to claim 73, wherein the flow guide is an annulus positioned over the at least one impeller located between the suction guide and the non-drive end.

75. A pump assembly according to claim 74, wherein the flow guide annulus is defined by an inner surface of the barrel casing and an outer surface of the pump cartridge.

76. A pump assembly according to claim 27, wherein there are provided three internal journal bearings.

77. A pump assembly according to claim 76, wherein an internal journal bearing is located towards the closure end of the barrel casing.

78. A pump assembly according to claim 76, wherein an internal journal bearing is located in the region of the suction branch of the barrel casing.

79. A pump assembly according to claim 76, wherein an internal journal bearing is located towards the second end portion of the barrel casing.

80. A pump assembly according to claim 76, wherein there is a negative pressure differential across at least one internal journal bearing between respective intermediate impeller stages and the suction branch.

81. A pump assembly according to claim 76, wherein there is a negative pressure differential across an internal journal bearing between the final impeller stage and the suction branch.

82. A pump assembly according to claim 76, wherein the internal journal bearings are product lubricated, hydrostatic bearings.

83. A pump assembly according to claim 76, wherein each internal journal bearing is associated with a balance chamber through which fluid is returned to the suction branch, with an associated pressure drop.

* * * * *